United States Patent [19]

Modrak et al.

[11] Patent Number: 4,868,031

[45] **Date of Patent: * Sep. 19, 1989**

[54] SOFT WATER-PERMEABLE POLYOLEFINS NONWOVENS HAVING OPAQUE CHARACTERISTICS

[75] Inventors: James P. Modrak, Rockdale County; Owen P. Roberts, Franklin County, both of Ga.

[73] Assignee: Hercules Incorporated, Wilmington, Del.

[ * ] Notice: The portion of the term of this patent subsequent to Jan. 17, 2006 has been disclaimed.

[21] Appl. No.: 261,044

[22] Filed: Oct. 21, 1988

Related U.S. Application Data

[63] Continuation-in-part of Ser. No. 64,363, Jun. 22, 1987, Pat. No. 4,798,757.

[51] Int. Cl.[4] ..... B32B 27/14

[52] U.S. Cl. ..... 428/198; 156/308.4; 428/286; 428/288; 428/296; 428/397

[58] Field of Search ..... 428/198, 286, 288, 296, 428/397; 156/308.4

[56] References Cited

U.S. PATENT DOCUMENTS

| | | | |
|---|---|---|---|
| 3,352,778 | 11/1967 | Brink et al. | 210/23 |
| 3,630,816 | 12/1971 | Parker | 161/72 |
| 3,676,540 | 7/1972 | Story | 264/177 F |
| 3,860,679 | 1/1975 | Shermadin | 264/40 |
| 3,903,348 | 9/1975 | Brewater et al. | 428/374 |

FOREIGN PATENT DOCUMENTS

| | | |
|---|---|---|
| 48054214A | 11/1971 | Japan . |
| 54050620A | 9/1977 | Japan . |
| 58081649A | 11/1981 | Japan . |
| 1504210 | 3/1978 | United Kingdom . |

*Primary Examiner*—Marion C. McCamish
*Attorney, Agent, or Firm*—John E. Crowe

[57] ABSTRACT

A method for controlling opacity, softness, and strength of polyolefin fiber-containing nonwoven material and corresponding nonwoven material, obtained by utilizing at least 25%, based on web weight, of polyolefin filament (a) having an original spun denier not exceeding about 24 dpf, (b) having a final drawn denier of not less than about 1 dpf, and (c) delta, diamond, or mixed delta and diamond cross-sectional configurations alone or combined with fiber having round or other cross sectional configuration.

30 Claims, No Drawings

SOFT WATER-PERMEABLE POLYOLEFINS NONWOVENS HAVING OPAQUE CHARACTERISTICS

This invention is a continuation-in-part of copending U.S. Ser. No. 064,363 filed on June 22, 1987, entitled "Soft Water-Permeable Polyolefin Nonwovens Having Opaque Characteristics", and relates to a method for increasing the opacity of polyolefin-containing nonwovens, and to the corresponding material, in which satisfactory levels of CD strength, appearance, softness, and water permeability are obtained in suitable combination without chemically changing the fiber or filament components or concentrations thereof, through control over filament cross-sectional configuration, now U.S. Pat. No. 4,798,767 issued Jan. 17, 1989.

BACKGROUND

Because of chemical inertness, low allergenic properties, high tensile strength and low melting point, polyolefin fiber and filaments, such as polypropylene are favored candidates for producing a variety of commercial products.

In attempting to apply existing technology and material to meet competitive marketing needs, however, it is sometimes found that the cost and technical problems which arise far exceed the marketing advantages gained.

By way of example, nonwoven material used as cover sheets for diapers, sanitary napkins, as well as covering material for numerous other purposes must generally be cost competitive and retain substantial cross directional (CD) strength and energy (toughness) as well surface softness.

Unfortunately, however, such properties are rarely compatible among nonwovens from synthetic fibers.

In particular, softness is usually gained in such material at the expense of lowered cross directional (CD) strength, and at a substantial increase in cost, figured on a Spun Weight/Time basis.

While the cross directional strength of such materials can usually be increased by increasing the bonding area and/ or number of bonding loci, this also is generally obtained at the expense of material softness and feel.

In effect, therefore, the resulting nonwoven product represents a deliberate compromise, in which particular desirable characteristics are maximized and certain undesirable characteristics minimized, if possible, and accepted in exchange.

In the case of personal contact products such as diaper cover stock and for numerous other covering purposes, it is also found desirable to satisfy certain nonjunctional esthetic properties, such as increased opacity (preferably 32%–45%) and stain-masking ability to enhance marketability. In order to accomplish such further improvement, however, the difficulty in obtaining an acceptable compromise or balance in properties is greatly increased.

Generally, staining and opacity problems in synthetic nonwovens have been catagorized and treated in the art as unresolved coloring problems, which have been greatly complicated by the chemically inert nature of polyolefins such as polypropylene. For this reason, colorants and brighteners are preferably introduced as spun melt components. This, in turn, has raised additional problems with respect to leaching, allergenic properties, CD strength loss, smaller spin quench windows, increased cost and the like.

It is an object of the present invention to increase the opacity of polyolefin-containing nonwoven material obtained from at least one web, without raising such added problems.

It is also an object of the present invention to minimize or avoid the need for high concentrations of colorants in synthetic nonwoven material to increase the opacity thereof.

THE INVENTION

The above objects are obtained in accordance with the present invention for increasing the opacity of polyolefincontaining nonwoven material obtained from at least one web without substantial loss in CD strength or toughness by incorporating, as a component of one or more web of the material an active amount of polyolefin filament having (a) at least one of a delta or diamond cross-sectional configuration;

(b) an initial spun denier not exceeding about 24 dpf and preferably about 6 dpf or less; and (c) a final drawn filament denier of not less than about 1 dpf and preferably above 1–2.5 dpf; and binding the resulting web(s) therefrom to obtain nonwoven material containing a total of not less than about 25% polyolefin filament of delta and/or diamond cross-sectional configuration, based on total web weight of the nonwoven material.

For present purposes the nonwoven material can comprise polyolefin filament of delta "Δ" or diamond cross sections, alone or admixed with art-recognized polyolefin or other filaments such as polyolefin or rayon and having other known cross- sectional configurations, such as "y", "x", "o" (round), oval, square, rectangular and the like, including blends thereof in combination with fibrillated film such as polyolefin film. The particular combination and amount of filament of delta or diamond configuration with round, for instance, will depend substantially upon the amount of opacity and toughness desired in combination with a soft or velvet feel.

Of interest, where a combination of softness and CD strength is desired, is the utilization of nonwoven material comprising polyolefin filament having both delta and/or diamond cross-sectional configuration the active fiber or filaments being present (a) as uniform blends in each laminated web, or (b) in the form of a plurality of homogeneous webs individually differing in concentration of filaments of delta and/or diamond cross-sectional configuration. Found particularly useful, in the instant invention, is the utilization of a ratio of delta and/or diamond-to-round cross-sectional configuration of about (25%–75%)-to-(75%–25%) and preferably about 50%-to-50% based on individual web weight or on total web weight, to achieve a desired total weight percent (ie an active amount).

It is also found that delta cross-sectional polyolefin filament within the instant nonwoven material have a preferred initial spun denier within a range of about 2.0–4.0 dpf and a final drawn denier correspondingly within the range of about 1.0–3.0 dpf (preferably 1.9–2.5 dpf), in order to retain both strength and softness. Generally, by use of the instant invention, one can achieve an opacity within the range of 32%–45% or even higher, depending upon one's choice of ancillary characteristics.

Production techniques for obtaining the various polyolefin cross-sectional configurations found useful for purposes of the instant invention, and production of the nonwoven itself are well known in the art and not generally found to be part of the present invention.

It is possible, however, to obtain nonwoven materials having substantially improved opacity and stain-hiding properties without substantial sacrifice in other areas by using spun bonded, needle punched and particularly thermal or sonic bonded techniques utilizing webs in machine or cross directions to obtain heavy nonwoven material or nonwoven material as light as 10–30 gm/yd$^2$, provided the above-described parameters are observed. Cost-wise and weight-wise, however, thermal bonding is found to be a preferred fabrication technique.

For purposes of the present invention is it also found that the filament or fiber mix in web(s) used to form nonwovens preferably varies from about 1–3.0 inches in length, with CD tensile strength generally favoring use of filament or fiber at the longer end of the range, and optimum CD energy (toughness) favoring use of mixtures of long and short staple within the above range. For example, a 50:50 mixture of 1 inch diamond with longer (e.g. 1.5"–2") round cross-sectional filament is found particularly useful in retaining both strength and a velvet-like feel.

Nonwoven materials, as above described, can be readily utilized as cover stock for multi layered products in the manner produced and described, for instance, in U.S. Pat. Nos. 4,112,153, 4,391,869, 4,573,987, and 4,578,066 since CD strength, softness, web uniformity, and line speed will not be seriously compromised.

The following examples and table further illustrate but do not limit the scope of the present invention.

EXAMPLE 1

A. Delta cross-sectional isotactic polypropylene filament of 4.0 dpf spun denier is produced in a conventional manner by melt spinning at 290° C. using PRO-FAX® 6501(*1)

*1 Commercially available from Hercules Incorporated of Wilmington, Del. polypropylene polymer degraded in the usual way with .025% Lupersol to an MFR (Melt Flow Rate)*2,4 value of 16 and spun, using a 700 hole delta spinnerette to obtain a final drawn denier of 2.1 dpf. Crimped(*2) bundles are then cut into one inch (1") length, collected, and compressed into bales for later testing.

*2 25 crimps/inch

*2A ASTM D 1238-82

B. Round cross-sectional polypropylene filament of 2.8 dpf spun denier is similarly produced in a conventional manner by melt spinning PRO-FAX® 6501 polypropylene polymer degraded to an MFR value of 13, spun at 290° C. to obtain a final drawn denier of 2.1 dpf, crimped(*2), cut into 2 inch lengths, collected, compressed and baled for later testing.

*2 25 crimps/inch

*2A ASTM D 1238-82

C. Delta cross-sectional polypropylene of 2.6 dpf spun denier is produced by melt spinning at 285° C., using PRO-FAX 6301(*1), and finally drawn to 2.2 dpf, crimped(*2), cut into two inch (2") bundles, collected, compressed, and baled for later testing.

*2 25 crimps/inch

*2A ASTM D 1238-82

D. Delta cross-sectional fiber of Example 1 A (2.1 dpf denier) is crimped (*2) and cut into 1.5 inch bundles collected and compressed into bales for later testing.

*2 25 crimps/inch

*2A ASTM D 1238-82

E. Round cross-sectional fiber of 2.8 dpf spun denier is drawn to 2.1 dpf as in Example I B, crimped (*2) and cut into 1.5 bundles, collected, and compressed into bales for later testing.

*2 25 crimps/inch

*2A ASTM D 1238-82

F. Staple cut fiber of delta and round cross-sectional configuration treated as described in C. and B. supra is combined in a homogeneous ratio of 50-to-50 parts by weight, collected, compressed and baled for later testing.

G. Round cross-sectional polypropylene filament of 1.5 dpf is produced in the manner of Example 1 B by melt spinning PRO-FAX 6501 polypropylene polymer degraded to an MFR value of 12 at 285° C. and drawn to obtain a final drawn denier of 1 dpf, crimped (*2), cut into 1.5 inch lengths, collected, compressed and baled for later testing.

H. Delta cross-sectional polypropylene of 1.5 dpf spun denier is produced the manner of Example I C by melt spinning PRO-FAX 6501 at 285° C. and drawn to 1.0 dpf, crimped as before (*2), *cut into* 1.5 inch bundles, compressed, and baled for later testing.

I. Round cross-sectional polypropylene filament of 8.0 dpf is produced from the same melt and in the manner of Example I B, spun to obtain a 6 dpf final denier, crimped (*2), cut into 1.5 inch lengths, collected, compressed, and baled for later testing.

EXAMPLE 2

A. Baled one inch (1") crimped polypropylene staple of delta cross-sectional configuration as described in Example I A is broken, and formed into two identical homogeneous webs in a conventional manner, and the webs superimposed in machine direction as they are transferred onto a continuous fiber glass belt, and thermally bonded, using a hot diamond-patterned calendar at 165° C./40 psi roll pressure to a obtain a nonwoven weighing 20 gm/yd$^2$. The resulting material, identified as NW-1, is then cut into convenient dimensions for conventional testing purposes and test results reported in Table I below.

B. Baled two inch (2") crimped polypropylene staple of round cross-sectional configuration as described in Example I B is broken, and formed into two identical homogeneous webs in a conventional manner, the webs being superimposed in machine direction as they are transferred onto a continuous fiber glass belt, and thermally bonded as in Example 2 A, using a hot diamond-patterned calendar to obtain a semi-opaque nonwoven weighing 20gm/yd$^2$. The resulting material, identified as NW-2, is then cut into convenient dimensions for testing purposes, standard tests run, and test results reported as control in Table I below.

C. The one inch (1") and two inch (2") crimped staple of delta and round configuration of Examples I A and I B is added to separate openers and conveyed into separate cards to form two homogeneous webs with a 25/75 weight ratio of 1" delta/2" round in a conventional manner, the webs being transferred onto a continuous fiber glass belt, and thermally bonded as before, using a hot diamond-patterned calendar to obtain a nonwoven material weighing 20.7 gm/yd$^2$. The resulting material, identified as NW-3, is then cut into convenient dimensions for testing purposes, standard tests run, and test results reported in Table I below.

D. The one inch (1") and two inch (2") crimped staple of Examples I A and I B is added to separate openers, broken, conveyed into separate cards, and formed into two homogeneous webs having a 50/50 ratio of 1" delta/2" round in a conventional manner, the webs being superimposed in machine direction as they are transferred onto a continuous fiber glass belt, and thermally bonded as before, using a hot diamond-patterned calendar to obtain a nonwoven material weighing 20.7 gm/yd$^2$. The resulting material, identified as NW-4, is then cut into convenient dimensions for testing purposes, standard tests run, and test results reported in Table I below.

E. The one inch (1") and two inch (2") crimped staple of Examples I A and I B is added to separate openers, broken and conveyed into separate cards and formed into two identical homogeneous webs of 1" delta and 2" round of 75/25 weight ratio in a conventional manner, the two webs being superimposed in machine direction, transferred onto a continuous fiber glass belt, and thermally bonded as before, using a hot diamond-patterned calendar to obtain a nonwoven material weighing 19.3 gm/yd$^2$. The resulting material, identified as NW-5, is then cut into convenient dimensions for testing purposes, standard tests run, and test results reported in Table I below.

F. Baled combined two inch (2") crimped staple of 50:50 delta:round cross-sectional configuration by weight, as described in Example I F (1 B and 1 C) is broken and formed into two identical mixed fiber webs in the same general manner as before, the webs being superimposed in machine direction, transferred onto a continuous fiber glass belt, and thermally bonded as before, using a hot diamond-patterned calendar to obtain a nonwoven material weighing 19.1 gm/yd$^2$. The resulting material identified as NW-6 is then cut into convenient dimensions for testing purposes, standard tests run, and test results reported in Table I below.

G. Baled 1.5 inch (1.5") crimped staple of drawn 2.1 dpf delta cross-section, as described Example I D is broken and formed into a web in the same manner as before. A second web is then prepared using 1.5 (1.5") crimped staple of 2.1 dpf circular cross-section as described in Example IE is broken and formed into a web of equal weight in the same manner as before.

The two webs, consisting of different fiber cross-section are superimposed in a machine direction transferred onto a continuous fiber glass belt, and thermally bonded as before, using a hot diamond-patterned calendar to obtain a nonwoven material weighing 18 gm/yd$^2$. The resulting material identified as NW-7 is then cut into convenient dimensions for testing purposes, standard tests run, and test results reported in Table I below.

H. Baled 1.5 inch (1.5") polypropylene staple of round cross-sectional configuration (extruded 1.5 dpf drawn 1 dpf) as described in Example 1 G is broken and formed in two identical homogeneous webs, the webs being superimposed in machine direction as they are transferred onto a continuous fiber glass belt then thermally bonded, using a hot diamond-patterned calendar at 165° C./40 psi roll pressure to obtain a nonwoven weighing 20 gm/yd$^2$. The resulting nonwoven, identified as NW-8, is then cut into convenient dimensions for testing purposes, and test results reported in Table I below as a control.

I. Baled 1.5 inch polypropylene staple of delta cross-sectional configuration drawn to 2.1 dpf from Example 1D, and round cross sectional configuration from 1E, are combined in the manner of Example 2 G supra to obtain an opaque nonwoven weighing about 20 gm/yd$^2$. The resulting material, identified as NW-9, is then cut into convenient dimensions for testing purposes and test results reported in Table I below as a control.

J. Baled 1.5 inch (1.5") polypropylene staple of round cross-sectional configuration and a drawn dpf of 6 from Example 1 I is broken and formed into two identical homogeneous webs in the manner of as in Example 2 H, to obtain a nonwoven, identified as NW-10, is then cut into convenient dimensions for testing purposes, and conventional test results reported in Table I below as a control.

TABLE 1

| Example | Material Sample | Bale From Ex. | Webs | Cross Section Δ:0 | Length (inches) Δ:0 | Opacity*4 in % | Feel*3A | CD*5 Dry (gms) |
|---|---|---|---|---|---|---|---|---|
| 2 A | NW-1 | 1A | Same | 100:0 | 1":0 | 41 | Coarse | 382 |
| 2 B*3 | NW-2 | 1B | Same | 0:100 | 0:2" | 26 | Excellent | 424 |
| 2 A/B | NW-3 | 1A<br>1B | Different | 25:75 | 1":2" | 32 | Excellent*7<br>Fairly Soft*6 | 447 |
| 2 A/B | NW-4 | 1A<br>1B | Different | 50:50 | 1":2" | 37 | Excellent*7 | 410 |
| 2 E | NW-5 | 1A<br>1B | Different | 75:25 | 1":2" | 39 | Fairly Soft*6 | 379 |
| 2 F | NW-6 | 1B<br>1C | Same | 50:50 | 2":2" | 35 | Soft | 454 |
| 2 G | NW-7 | 1D<br>1E | Different | 50:50 | 1.5":1.5" | 35 | Excellent*7 | 364 |
| 2 H*3 | NW-8 | 1G | Same | 0:100 | 0:1.5" | 42 | Excellent | 177 |
| 2 I*3 | NW-9 | 1H | Same | 100:0 | 1.5":1.5" | 44 | Soft | 234 |
| 2 J*3 | NW-10 | 1I | Same | 0:100 | 1.5":1.5" | 23 | Coarse (like polyester) | 304 |

*3Control.
*3AFor evaluation purposes the term "Coarse" here denotes an unsatisfactory feel for commercial use as diaper coverstock and "Excellent" denotes a superior feel and softness acceptable for commercial usage, "Soft" denotes high quality commercially acceptable feel and softness while "Fairly Soft" denotes marginally acceptable feel and softness.
*4An opaqueness of 39% or above is here considered commercially superior as diaper coverstock and 32% considered a modest though significant improvement.
*5A CD dry strength of 300 gm or higher is considered commercially acceptable as diaper coverstock.
*6Tested for softness on the delta cross-sectional side.
*7Tested for softness on the circular cross-sectional side.

EXAMPLE 3

A Diamond cross-sectional isotactic polypropylene filament of 6.0 dpf spun denier is obtained in a conventional manner by melt spinning at 290° C. using PROFAX® 6501*1polypropylene polymer, degraded, spun and processed in the manner of Example 1 A to obtain a final drawn denier of 2.1, then cut to one inch (1") length, baled, and stored for later use.

B. Delta cross-sectional isotactic polypropylene filament having a 2.6 dpf spun denier, is produced in the manner described in Example 1 C to a drawn denier of 2.1, then cut into two inch (2") bundles and baled for later testing.

C. Round cross-sectional isotactic polypropylene filament of 2.8 dpf spun denier is produced as described in Example 1 B to a drawn denier of 2.1 then cut into two inch (2") bundles and baled for later testing.

EXAMPLE 4

Three test nonwoven samples are prepared as follows:

A. Nonwoven test strips are prepared by conventionally producing homogeneous webs varying in weight within a range of about 10–15 gm/yd$^2$, using filaments of diamond cross-section configuration from Example 3 A. Random combinations of two homogeneous webs, thus produced, are superimposed in machine direction onto a continuous fiber glass belt and bonded using a diamond-patterned calendar at 165° C./40 psi. The resulting nonwoven test materials are cut, weighed and tested for opacity using a Diano Match Scan II color spectrometer, and the results reported in Table II below as S-1, S-2 and S-3.

B. Nonwoven test strips are prepared by producing homogeneous webs varying in weight within a range of about 10–15 gm/yd$^2$ using the filaments of round cross-sectional configuration reported in Example 3 C. Random combinations of two homogeneous webs, thus produced, are superimposed in machine direction onto a continuous fiber glass belt and bonded using a diamond-patterned calendar at 165° C./40 psi. The resulting nonwovens are cut, weighted and tested for opacity using a Diano Match Scan II Color Spectrometer, and the results reported in Table II below as S-10, S-11 and S-12.

C. Nonwoven test strips are prepared by conventionally producing homogeneous webs varying in weight from about 10–15 gm/yd$^2$ using filaments of delta cross-sectional configuration reported in Example 3 B. Random combinations of two homogenous webs thus produced are superimposed in machine direction onto a continuous fiber glass belt and bonded using a diamond-patterned calendar at 165° C./40 psi. The resulting nonwovens are cut, weighed and tested for opacity as before and test results reported in Table II as S-4, S-5 and S-6.

D. Nonwoven test strips are prepared by producing homogenous webs of diamond and of delta cross-sectional configuration as in Examples 3 A and 3 B supra. Webs of different fiber cross section are randomly chosen, superimposed in machine direction, and bonded to obtain test nonwovens having 50%:50% by weight of diamond:delta-fiber content, then the nonwoven is cut, weighted and tested as before. Test results are reported in Table II below as S-7, S-8 and S-9.

TABLE II

| Sample | Fiber Content Cross-Section Configuration | Nonwoven wt gm/yd$^2$ (2 webs) | Opacity % |
|---|---|---|---|
| S-1 | 100% Diamond | 20.0 | 37.0 |
| S-2 | 100% Diamond | 21.5 | 37.5 |
| S-3 | 100% Diamond | 26.0 | 40.5 |
| S-4 | 100% Delta | 20.1 | 41.0 |
| S-5 | 100% Delta | 21.5 | 42.2 |
| S-6 | 100% Delta | 26.0 | 46.0 |

TABLE II-continued

| Sample | Fiber Content Cross-Section Configuration | Nonwoven wt gm/yd$^2$ (2 webs) | Opacity % |
|---|---|---|---|
| S-7 | 50% Diamond<br>50% Delta | 20.0 | 40.5 |
| S-8 | 50% Diamond<br>50% Delta | 21.5 | 41.0 |
| S-9 | 50% Diamond<br>50% Delta | 26.0 | 44.0 |
| S-10 | 100% Round | 20.2 | 28.0 |
| S-11 | 100% Round | 21.5 | 29.5 |
| S-12 | 100% Round | 26.2 | 34.0 |

What we claim and desire to protect by letters patent is:

1. A polyolefin-containing nonwoven material comprising in combination at least one fiber web, containing not less than 25%, based on total web weight, of polyolefin filament having (a) at least one of a delta or diamond cross-sectional configuration (b) said polyolefin filament having an initial spun denier not exceeding about 24 dpf, and (c) a final drawn denier of not less than about 1 dpf.

2. A nonwoven material of claim 1, wherein said nonwoven material comprises polyolefin filament of delta and round cross-sectional configuration.

3. The nonwoven material of claim 2, wherein a blend of diamond and round cross-sectional configuration is utilized in each web.

4. The nonwoven material of claim 3 wherein the material comprises polyolefin filament having a ratio of diamond-to-round cross-sectional configuration of about (25%–75%)-to-(75%–25%), based on individual web weight.

5. The nonwoven material of claim 3, wherein the material comprises polyolefin filament having a ration of diamond-to-round cross-sectional configuration of about 50%-to-50% based on total web weight.

6. The nonwoven material of claim 2, wherein a plurality of fiber webs are utilized, having different filament concentrations of diamond cross-sectional configuration.

7. The nonwoven material of claim 6, wherein the material comprises polyolefin filament having a ratio of diamond-to-round cross sectional configuration of about (25%–75%)-to-(75%–25%), based on total web weight.

8. The nonwoven material of claim 2, wherein the material comprises polyolefin of filament having a ration of diamond-to-round cross-sectional configuration of about 50%:505 based on individual web weight.

9. A nonwoven material of claim 1, wherein said nonwoven material comprises polyolefin filament of diamond and round configuration.

10. A nonwoven material of claim 1, wherein said nonwoven material comprises polyolefin filament of diamond and delta configuration.

11. A nonwoven material of claim 1, wherein said nonwoven material comprises polyolefin filament of delta, diamond, and round configuration.

12. The nonwoven material of claim 1 wherein the polyolefin filament has a length within the range of about 1"–2".

13. The nonwoven material of claim 1 wherein the polyolefin filament comprises polypropylene and having a length within the range of about 1"-2".

14. A method of increasing the opacity of polyolefin-containing nonwoven material from at least one web, comprising incorporating as a component of said web, an active amount of polyolefin filament having (a) at least one of a delta or diamond cross sectional configuration;

(b) an initial spun denier not exceeding about 24 dpf; and (c) a final drawn denier of not less than about 1 dpf; and binding said web to obtain nonwoven material containing a total of not less than about 25% polyolefin filament of at least one of said delta or diamond cross sectional configuration, based on total web weight of said nonwoven material.

15. A method of claim 14, wherein said polyolefin filament comprises up to 100% by fiber weight of delta cross sectional configuration generated from an initial spun denier not exceeding about 4 dpf and a final drawn denier of not less than about 1 dpf.

16. A method of claim 15, wherein the resulting nonwoven material comprises filament of mixed delta and round cross-sectional configuration.

17. A method of claim 15, wherein a blend of polyolefin filament of delta and round cross-sectional configuration is utilized in each web of said nonwoven material.

18. A method of claim 15, wherein the nonwoven material comprises filaments having a ratio of delta-to-round cross-sectional configuration of about (25%-75%)-to-(75%-25%) by individual web weight.

19. A method of claim 15 wherein the nonwoven material comprises filaments having a ratio of delta-to-round cross-sectional configuration of about 50%-to-50% by individual web weight.

20. A method of claim 15, wherein the polyolefin filament has an initial spun denier within the range of about 2.0-4.0 dpf and a final drawn denier within the range of about 1.0-3.0 dpf.

21. A method of claim 20, wherein the polyolefin filament is polypropylene filament.

22. A method of claim 14 wherein said active amount of polyolefin filament comprises up to 100% by fiber weight of a diamond cross sectional configuration generated from an initial spun denier within a range of about 24-6 dpf and a final drawn denier of not less than about 1.9 dpf.

23. A method of claim 22, wherein the resulting nonwoven material comprises filament of mixed delta and diamond cross-sectional configuration.

24. A method of claim 22, wherein the resulting nonwoven material comprises filament of mixed diamond and round cross-sectional configuration.

25. A method of claim 22, wherein the nonwoven material comprises filaments having a ratio of diamond-to-round cross-sectional configuration of about (25%-75%)-to-(75%-25%) by total web weight.

26. A method of claim 22, wherein the nonwoven material comprises filaments having a ratio of diamond-to-round cross-sectional configuration of about 50%-to-50% by total web weight.

27. A method of claim 22, wherein the polyolefin filament within the nonwoven material has an initial spun denier within the range of about 12.0-6.0 dpf and a final drawn denier within the range of about 2.0-3.0 dpf.

28. A method of claim 27, wherein the polyolefin filament is polypropylene filament.

29. A method of claim 14 wherein the nonwoven material comprises a plurality of webs differing in concentration of fiber of a delta cross-sectional configuration.

30. A method of claim 14, wherein the nonwoven material comprises a plurality of webs differing in concentration of fiber of a diamond cross-sectional configuration.

* * * * *